US010269370B2

(12) United States Patent
Xu

(10) Patent No.: US 10,269,370 B2
(45) **Date of Patent: *Apr. 23, 2019**

(54) ADAPTIVE FILTER CONTROL

(71) Applicant: Cirrus Logic International Semiconductor Ltd., Edinburgh (GB)

(72) Inventor: Zhengyi Xu, Hampshire (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/934,182

(22) Filed: Mar. 23, 2018

(65) Prior Publication Data

US 2018/0211683 A1 Jul. 26, 2018

Related U.S. Application Data

(63) Continuation of application No. 14/879,401, filed on Oct. 9, 2015, now Pat. No. 9,959,884.

(51) Int. Cl.

| | |
|---|---|
| ***G10L 21/0388*** | (2013.01) |
| ***G10L 21/0216*** | (2013.01) |
| ***G10L 21/0232*** | (2013.01) |
| ***H04R 3/00*** | (2006.01) |

(52) U.S. Cl.

CPC ..... *G10L 21/0388* (2013.01); *G10L 21/0216* (2013.01); *G10L 21/0232* (2013.01); *H04R 3/005* (2013.01); *G10L 2021/02165* (2013.01); *G10L 2021/02166* (2013.01); *H04R 2499/11* (2013.01)

(58) Field of Classification Search

None

See application file for complete search history.

(56) References Cited

U.S. PATENT DOCUMENTS

| | | | |
|---|---|---|---|
| 5,680,337 | A | 10/1997 | Pedersen et al. |
| 2002/0048377 | A1 | 4/2002 | Vaudrey et al. |
| 2008/0027722 | A1 | 1/2008 | Haulick et al. |
| 2010/0150375 | A1 | 6/2010 | Buck |
| 2013/0066628 | A1 | 3/2013 | Takahashi |

(Continued)

FOREIGN PATENT DOCUMENTS

| | | | |
|---|---|---|---|
| EP | 2196988 | A1 | 6/2010 |
| EP | 2237270 | A1 | 10/2010 |
| WO | 2011129725 | A1 | 10/2011 |

OTHER PUBLICATIONS

Combined Search and Examination Report of the UKIPO, Application No. GB1520770.7, dated May 17, 2016.

(Continued)

*Primary Examiner* — Paul W Huber

(74) *Attorney, Agent, or Firm* — Jackson Walker L.L.P.

(57) ABSTRACT

A sound processing circuit comprises a first input for receiving a first input signal, and a second input for receiving a second input signal. A first adaptive filter receives the first input signal, and an error calculation block calculates an error between the second input signal and the output of the first adaptive filter, and outputting an error signal. A second adaptive filter receives the error signal, and an output calculation block subtracts an output of the second adaptive filter from the first input signal to generate an output signal. The adaptation of first and second adaptive filters is controlled based on a magnitude coherence between the first and second input signals.

24 Claims, 8 Drawing Sheets

(56) References Cited

U.S. PATENT DOCUMENTS

| | | | |
|---|---|---|---|
| 2014/0086425 | A1 | 3/2014 | Jensen et al. |
| 2015/0172814 | A1 | 6/2015 | Usher et al. |

OTHER PUBLICATIONS

L.E. Bouquin-Jeannes, R et al., "Study of a voice activity detector and its influence on a noise reduction system", Speech Communication, Elsevier Science Publishers, Amsterdam, NL, vol. 16, No. 3, Apr. 1, 1995, pp. 245-254.

International Search Report and Written Opinion of the International Searching Authority, International Application No. PCT/GB2016/052928, dated Jan. 3, 2017.

Examination Report under Section 18(3), UKIPO, Application No. GB15207701, dated Jan. 31, 2019.

Bouquin, Jeannes et al., "Proposal of a voice activity detector for noise reduction," Electronics Letters, 1994, vol. 30, Issue 12, p. 930-932.

(b)

(a)

ADAPTIVE FILTER CONTROL

The present disclosure is a continuation of U.S. Non-provisional patent application Ser. No. 14/879,401, filed Oct. 9, 2015, which is incorporated by reference herein in its entirety.

FIELD OF DISCLOSURE

This invention relates to the use of the magnitude coherence between two input signals for controlling adaptive filters in the processing of the input signals.

BACKGROUND

Adaptive filters have been widely applied for many years. An adaptive filter comprises a linear filter system with a transfer function between an input signal and an output signal, the transfer function comprising coefficients which can be controlled to optimise some measure of the output signal, for instance to minimise the error between the output signal and a supplied reference signal. An adaptive filter also comprises some adaptation control mechanism to control the coefficients. The coefficients may be initially set to some initial values, and are then controlled to converge over time to the optimum value based on the input signal and reference signal present. As with control loops in general, the adaptation of the coefficients may occur more quickly or more slowly or be over-damped or under-damped based on parameters of the design of the adaptation control mechanism, i.e. based on adaptation parameters or convergence factors of the adaptive filter.

In applications such as speech enhancement and acoustic noise cancellation, adaptive filters can be used to estimate the acoustic echo path for echo cancellation. In the case of a device with multiple microphones operating in a hands-free mode, adaptive filters can be used to model the speech path or interference paths in order to adaptively remove noise from a desired speech signal.

In multi-microphone applications, especially in devices with a small number of closely spaced microphones, each microphone may pick up significant amounts of both the desired speech signal and undesired background noise. The speech and noise components may be separated by using two or more adaptive filters. However it is preferable to adapt some filters when speech is present and to adapt others when only the background noise is present. This adaption mode control may be driven by a signal to noise ratio (SNR) measurement, using a threshold value to determine when speech is present and adapting one or more filters depending on the result of this determination. However, it is difficult to produce an accurate measurement of the signal-to-noise ratio and to thence derive reliable decisions, especially in devices with a small number of microphones or with particularly non-stationary noise conditions.

Another disadvantage of using SNR based mode control is that it assumes that the SNR of a designated voice microphone is always higher than that of a designated noise microphone. This could be true when the device is in use as a handset, when the voice microphone is very close to the user's mouth. However, this is not always true in practice, for example when the device is in use as a speakerphone. For example, the handheld handset could be rotated, or the user could walk around a table on which the handset is positioned with an arbitrary orientation. Or it could be that the voice microphone is physically further away from the user's mouth than the noise microphone, in order to be well separated from the loudspeaker for better echo performance. In these situations, the SNR measured in the voice microphone could be similar to, or even lower than, that of the noise microphone and the false decision made from SNR measurement could finally result in heavy speech distortion.

Other methods involve different methods of speech detection, but these are also difficult to use in the limited conditions imposed by handheld devices.

SUMMARY

According to the present invention there is provided a sound processing circuit comprising: a first input for receiving a first input signal, a second input for receiving a second input signal, a first adaptive filter for receiving the first input signal, an error calculation block for calculating an error between the second input signal and the output of the first adaptive filter, and outputting an error signal, a second adaptive filter for receiving the error signal, an output calculation block for subtracting an output of the second adaptive filter from the first input signal to generate an output signal, wherein the adaptation of first and second adaptive filters is controlled based on a magnitude coherence between the first and second input signals.

The respective convergence factors of the first and second adaptive filters may be controlled based on the magnitude coherence. The convergence factor for each adaptive filter may be generated for each frequency bin and time frame of the first and second input signals.

The convergence factors of the first and second adaptive filters may be generated such that, when the convergence factor in one adaptive filter is a maximum convergence factor, the convergence factor in the other adaptive filter is a minimum convergence factor.

The first input signal may contain primarily a target signal and the second input signal may contain primarily ambient noise, such that the first adaptive filter is a noise estimation adaptive filter. The second adaptive filter may be a noise cancellation adaptive filter.

If the magnitude coherence between the first and second input signals is greater than an upper threshold value, the first adaptive filter may be controlled to have a maximum convergence factor, and the second adaptive filter may be controlled to have a minimum convergence factor.

If the magnitude coherence between the first and second input signals is lower than a lower threshold value, the first adaptive filter may be controlled to have a minimum convergence factor, and the second adaptive filter may be controlled to have a maximum convergence factor.

If the magnitude coherence is above a first threshold value for a particular frequency bin and time frame, the first adaptive filter may be controlled to have a maximum convergence factor for that frequency bin and time frame, or if the magnitude coherence is below a second threshold value for a particular frequency bin and time frame, the first adaptive filter may be controlled to have a minimum convergence factor for that frequency bin and time frame.

The first threshold value may be the same as the second threshold value.

Alternatively, the first threshold value may be an upper threshold value while the second threshold value is a lower threshold value, and the upper threshold value is larger than the lower threshold value. In that case, if the magnitude coherence is between the upper and lower threshold values for a particular frequency bin and time frame, the adaptive filter convergence factor may be controlled by generating the convergence factor using a linear relationship, or using a polynomial curve.

If the magnitude coherence is above a third threshold value for a particular frequency bin and time frame, the second adaptive filter may be controlled to have a minimum convergence factor for that frequency bin and time frame, or, if the magnitude coherence is below a fourth threshold value for a particular frequency bin and time frame, the second adaptive filter may be controlled to have a maximum convergence factor for that frequency bin and time frame.

The third threshold value may be the same as the fourth threshold value.

Alternatively, the third threshold value may be an upper threshold value while the fourth threshold value is a lower threshold value, and the upper threshold value is larger than the lower threshold value. In that case, if the magnitude coherence is between the upper and lower threshold values for a particular frequency bin and time frame, the adaptive filter convergence factor may be controlled by generating the convergence factor using a linear relationship, or using a polynomial curve.

The first and second input signals may comprise values in a plurality of frequency bins, and the frequency bins may be grouped into frequency sub-bands and the adaptive filter convergence factor generated for each frequency sub-band.

The magnitude coherence may be a weighted magnitude coherence $\overline{M_{coh}}(k,l)$ calculated as follows:

$$\overline{M_{coh}}(k, l) = w(l)M_{coh}(k, l), \text{ wherein:}$$

$$w(l) = \begin{cases} w_0, & \text{if } \frac{1}{k2-k1+1}\sum_{k=k1}^{k2} M_{coh}(k, l) < w_{td}(k) \\ 1, & \text{otherwise} \end{cases}.$$

According to a second aspect, there is provided a portable device comprising: a first microphone to provide a first input signal, a second microphone to provide a second input signal, and a sound processing circuit, wherein the sound processing circuit comprises: a first adaptive filter for receiving the first input signal, an error calculation block for calculating an error between the second input signal and the output of the first adaptive filter, and outputting an error signal, a second adaptive filter for receiving the error signal, an output calculation block for subtracting an output of the second adaptive filter from the first input signal to generate an output signal, wherein the adaptation of first and second adaptive filters is controlled based on a magnitude coherence between the first and second input signals.

The portable device may further comprise at least one third microphone, and a microphone selection circuit for determining which of the first, second and third microphones are used to provide the first and second input signals.

The microphones may be between 5 cm and 25 cm apart.

The device may be communication device.

According to a further aspect, there is provided a method of controlling a frequency domain adaptive filter, the method comprising: receiving a first input signal and a second input signal, wherein the first and second input signals are in the frequency domain, calculating the magnitude coherence between the first and second signals, and using the magnitude coherence to control the adaptation parameters of the adaptive filter.

The adaptive filter may receive one of the first and second input signals as an input signal to be filtered.

The adaptive filter may receive an error signal indicative of the error between the first and second input signals as an input signal to be filtered.

The step of using the magnitude coherence to control the adaptive filter may comprise using the magnitude coherence to control the adaptive filter adaption convergence factor.

The convergence factor for the adaptive filter may be generated for each frequency bin and time frame of the first and second input signals.

The adaptive filter may be applied for noise estimation, or for noise cancellation.

The method may further comprise, if the magnitude coherence is above a first threshold value for a particular frequency bin and time frame, controlling the adaptive filter to have a maximum convergence factor for that frequency bin and time frame, or, if the magnitude coherence is below a second threshold value for a particular frequency bin and time frame, controlling the adaptive filter to have a minimum convergence factor for that frequency bin and time frame.

The first threshold value may be the same as the second threshold value.

Alternatively, the first threshold value may be an upper threshold value while the second threshold value is a lower threshold value, and the upper threshold value is larger than the lower threshold value. In that case, the method may further comprise: if the magnitude coherence is between the upper and lower threshold values for a particular frequency bin and time frame, controlling the adaptive filter convergence factor by generating the convergence factor using a linear relationship, or using a polynomial curve.

The method may further comprise, if the magnitude coherence is above a third threshold value for a particular frequency bin and time frame, controlling the adaptive filter to have a minimum convergence factor for that frequency bin and time frame, or, if the magnitude coherence is below a fourth threshold value for a particular frequency bin and time frame, controlling the adaptive filter to have a maximum convergence factor for that frequency bin and time frame.

The third threshold value may be the same as the fourth threshold value.

Alternatively, the third threshold value may be an upper threshold value while the fourth threshold value is a lower threshold value, and the upper threshold value is larger than the lower threshold value. In that case, the method may further comprise, if the magnitude coherence is between the upper and lower threshold values for a particular frequency bin and time frame, controlling the adaptive filter convergence factor by generating the convergence factor using a linear relationship, or using a polynomial curve.

The first and second input signals may comprise values in a plurality of frequency bins, and the frequency bins may then be grouped into frequency sub-bands and the adaptive filter convergence factor generated for each frequency sub-band.

The magnitude coherence may be a weighted magnitude coherence $\overline{M_{coh}}(k,l)$ and the weighted coherence calculated as follows:

$$\overline{M_{coh}}(k, l) = w(l)M_{coh}(k, l) \text{ wherein,}$$

$$w(l) = \begin{cases} w_0, & \text{if } \frac{1}{k2-k1+1}\sum_{k=k1}^{k2} M_{coh}(k, l) < w_{td}(k) \\ 1, & \text{otherwise} \end{cases}$$

A computer program product is also provide comprising computer readable code, for causing a processing device to perform a method according to the previous aspect.

BRIEF DESCRIPTION OF THE DRAWINGS

For a better understanding of the present invention, and to show how it may be put into effect, reference will now be made, by way of example, to the accompanying drawings, in which.

DETAILED DESCRIPTION

Figure 1A:
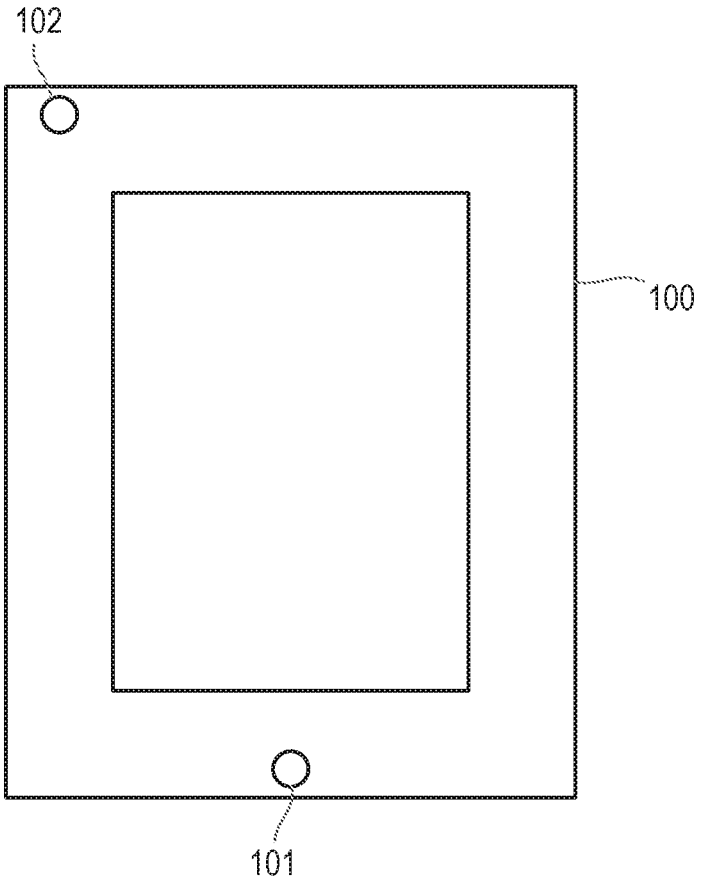
FIG. 1*a* illustrates a mobile phone device according to embodiments of the invention.

FIG. 1*a* illustrates a mobile phone device 100 according to embodiments of the invention. This mobile device is set up with two microphones 101, 102 for detecting sounds and generating respective electrical signals.

Although embodiments of the invention are described herein with reference to use in a mobile phone device, it will be appreciated that the invention is equally applicable to other devices, such as laptop or tablet computers, games consoles, audio-visual devices, or the like. Embodiments of the invention may be used for noise reduction in the application of video communication, for example using a multi-microphone webcam deployed on the top of a laptop computer or TV set. Embodiments of the invention may be used for speech pre-processing in the application of speech recognition or in the application of controlling a smart device using voice commands. In these use cases, there is a danger that the voice commands will not be picked up accurately or will not be completely picked up in noisy or reverberant environments. Embodiments of the invention may be used to detect speech and clean it for better speech recognition.

In this embodiment illustrated in FIG. 1*a*, the microphones 101, 102 are positioned at either end of the mobile device 100 such that they detect significantly different sounds. For example, the distance between them may be more than 5 cm and less than 25 cm, and more typically less than 20 cm or less than 15 cm. It will be appreciated, however, that different positioning, orientation and distances between the two microphones could be used, or more microphones could be used, as described in FIG. 3.

In the device configuration illustrated in FIG. 1*a*, both microphones would pick up target speech. The difference in the levels of the speech picked up by the microphones depends on the microphone configuration on the handset and on the handset orientation. In the assumption of a diffuse noise environment, both microphones would also pick up similar levels of ambient noise. Because of this, it is difficult to provide a robust identification as to whether the detected sounds contain speech or just contain ambient noise, based purely on signal power measurements, e.g. estimates of signal-to-noise. Also, for relatively small devices, say a laptop computer with less than 25 cm between the microphones, or a cellphone with less than 20 cm or less than 15 cm between the microphones, there is relatively little benefit that can be obtained by beamforming techniques to separate the speech from ambient noise.

The inventor has realised that a superior measure for detecting the presence of speech rather than noise is the magnitude coherence between the respective signals generated by two microphones. This measure is explained in more detail below. If a user is speaking, then the magnitude coherence between the signals generated by the two microphones will be high across a significant part of the frequency band. In contrast, if there is no speech, the magnitude coherence between the signals generated by the two microphones will be low.

Figure 1B:
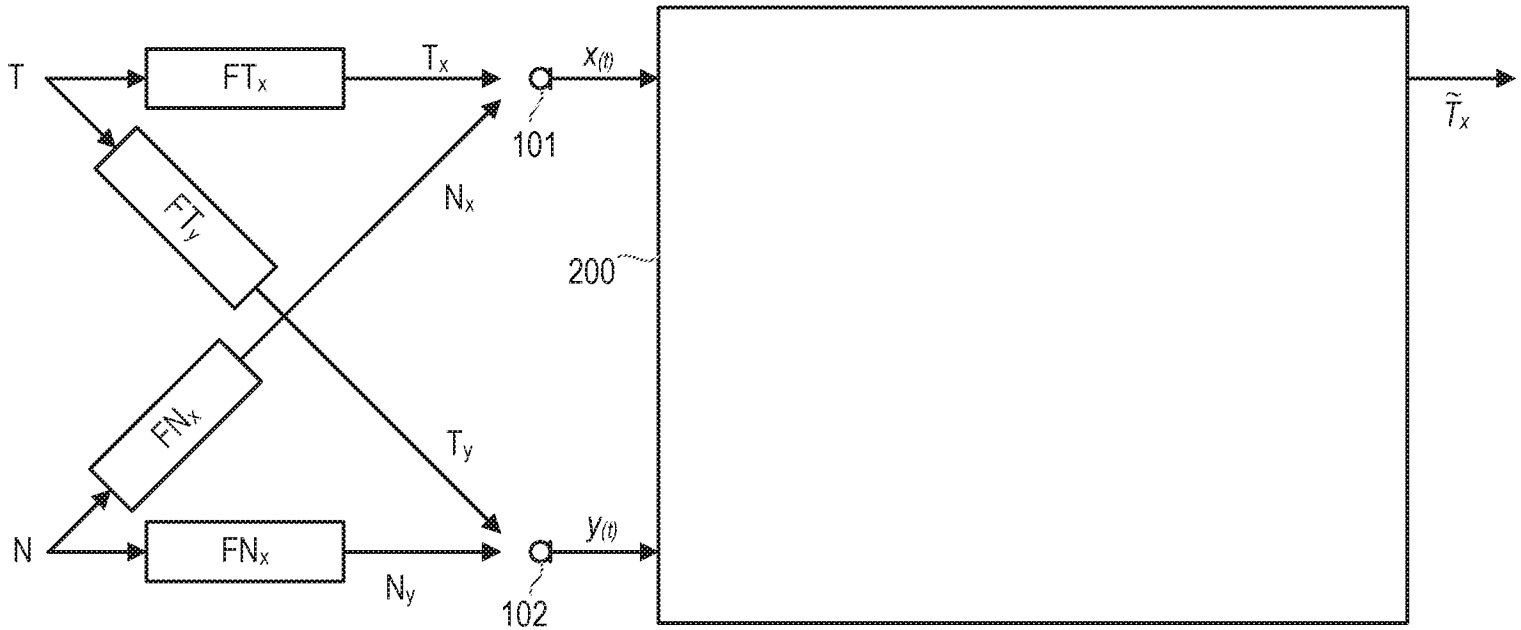
FIG. 1*b* schematically illustrates sound signals reaching a device.

FIG. 1*b* illustrates two microphone signals X(t), Y(t) being input into a sound processing device 200 from respective microphones 101, 102, according to an embodiment of the invention. One microphone 101 receives a first signal Tx via an acoustic path with transfer function FTx from a first source signal T but also receives a second signal component Nx via a transfer function FNx from a second source signal N and provides a microphone signal X(t) as the sum of the locally received signals Tx and Nx. Similarly, a second microphone 102 receives a first signal Ny via an acoustic path with transfer function FNy from the second source signal N but also receives a second signal component Ty via a transfer function FTy from the first source signal T.

In some scenarios, the first source signal T may be a target signal, such as the sound of a user speaking, while the second source signal N may be an ambient noise signal, and the device 100 may be positioned and oriented such that the microphone 101 is close to the user's mouth, meaning that the target signal component Tx detected by the microphone 101 is larger than the noise signal component Nx detected by the microphone 101, and that the target signal component Tx detected by the microphone 101 is larger than the target signal component Ty detected by the microphone 102. However, the embodiments described herein do not depend on these conditions, and are equally applicable when the device 100 is used in positions and orientations where these conditions do not apply.

In some application scenarios, there may be multiple noise sources $N_1$, $N_2$ . . . with respective transfer functions, but the noise sources may still be adequately approximated by a single noise source N and pair of transfer functions FNx, FNy.

The sound processing block 200 accepts the signals X(t) and Y(t) and processes them to provide a signal $\tilde{T}x$, representing an estimate of the original target source signal T (or more precisely of the target source related signal Tx as actually received by the microphone via transfer function FTx).

Note that as used herein the term 'block' shall be used to refer to a functional unit or module which may be implemented at least partly by dedicated hardware components such as custom defined circuitry and/or at least partly be implemented by one or more software processors or appropriate code running on a suitable general purpose processor or the like. A block may itself comprise other blocks or functional units.

Figure 2:
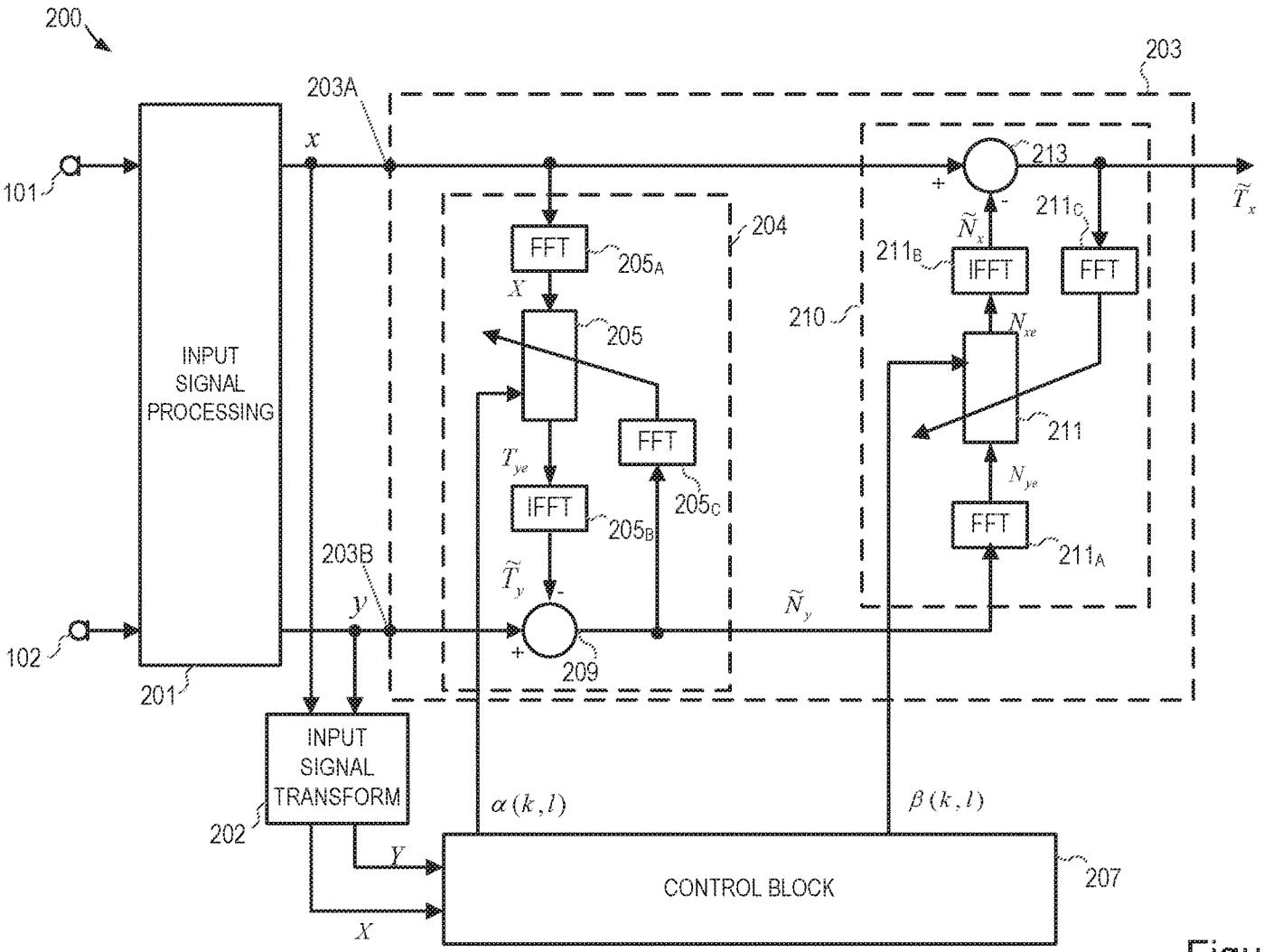
FIG. 2 illustrates processing circuitry according to an embodiment of the invention.

FIG. 2 illustrates a sound processing device generally indicated by label 200 according to an embodiment of the invention. The microphones 101 and 102 may be positioned as shown in FIG. 1 to receive input sound signals. The target sound signal may for example be speech. In this example, the microphone 101 is selected as voice reference and microphone 102 is noise reference. The function of the device 200 is therefore to filter the signal generated by the microphone 101 to reduce the noise it contains while keeping its speech signal undistorted.

The signal generated by the microphone 101 will therefore be referred to as the voice reference and the signal generated by the microphone 102 will be referred to as the noise reference. It will be appreciated however, that the signal generated by the microphone 101 will contain a component based on the ambient noise, while the signal generated by the microphone 102 will contain a component based on the user's voice. The signal to noise ratio of each microphone depends on the handset orientation and could varies in real use cases.

The voice and noise signals generated by the microphones 101 and 102 respectively are input into an input signal processing block 201. The input signal processing block 201 may comprise an analogue-to-digital conversion function if the microphone signals may be analogue electrical signals, or may comprise some digital processing of the microphone signals such as conversion from an oversampled 1-bit delta-sigma data stream into a multi-bit representation at a lower sample rate, including any necessary filtering. The time domain signals x(t) and y(t) are then used as the input signals for a sound processing circuit 203.

The sound processing circuit 203 comprises a first input 203A for receiving the first input signal x(t) and a second input 203B for receiving the second input signal y(t). Both inputs contain target speech and ambient noise. In circuit 203, x(t) is assumed as target reference and y(t) is assumed as noise reference. Circuit 203 aims to generate a noise estimation from both inputs and subtract it from the target reference x(t) to enhance the target.

The signal x(t) is input into a first adaptive filter 204 which comprises a filter block 205. The filter 204 is a frequency domain adaptive filter. It first transfers the time domain input to the frequency domain using, typically, a Fast Fourier Transform (FFT) block 205A. The FFT may be generated once per frame, each frame comprising a set of signal samples over some time interval. The frames may be disjoint, i.e. non-overlapping in time, or may overlap by one or more time samples. For example each frame may also include the later half of the previous frame's set of samples. The frequency domain signal is denoted as X(k,l), where k is the frequency bin and l denotes the specific time or frame. The adaptive filter block 205 filters the signal X(k,l) based on a set of filter coefficients hT(k,l) to provide a signal $T_{ye}$(k,l). It is then transferred back to time domain using Inverse FFT (IFFT) block 205B. The time domain signal, denoted as $\tilde{T}_y$, is then subtracted by subtractor 209 from the input signal y(t) to provide an error signal $\tilde{N}_y$.

The error signal $\tilde{N}_y$ is transferred back to frequency domain using FFT block $\mathbf{205}_c$, with the result denoted as $N_{ye}$(k, l). It is then used to update the coefficients of the adaptive filter 205 based on an adaption control and a specific adaptive algorithm. The adaptive filter inherently can only minimise components of $\tilde{N}_y$ which are correlated to the input x. So $\tilde{T}_y$ converges to a close estimation of signal component $T_y$ as shown in Figure A, and $\tilde{N}_y$ converges to the estimation of $N_y$ in Figure A, i.e., to an estimation of noise components of the signal picked up by microphone 102. The result of the adaptation is that the filtering applied to the input signal x corresponds to the ratio of the acoustic transfer function $FT_y/FT_x$.

The noise estimate signal $\tilde{N}_y$ is input into a second adaptive filter 210. This is a frequency domain adaptive filter. It first transfers the time domain input to frequency domain using, typically, a Fast Fourier Transform block $\mathbf{211}_A$ The frequency domain signal is denoted as $N_{ye}$(k,l), where k is the frequency bin and l denotes the specific time or frame. The adaptive filter block 211 filters the signal $N_{ye}$(k,l) based on a set of filter coefficients hN(k,l) to provide a signal $N_{xe}$(k,l). It is then transferred back to time domain using an Inverse FFT (IFFT) block 211B, with the result denoted as $\tilde{N}_x$, and this is then subtracted by a subtractor 213 from the input signal x(t). The error signal $\tilde{T}_x$ is the output of block 203 and is transferred back to frequency domain using FFT block $\mathbf{211}_c$. It is then used to update the coefficients of adaptive filter 211 based on an adaption control and a specific adaptive algorithm. The adaptive filter inherently can only minimise components of $\tilde{T}_x$ which are correlated to its input signal $\tilde{N}_y$ so $\tilde{N}_x$ converges to a close estimate of signal component $N_x$ of Figure A, i.e. the noise component of the signal picked up by microphone 102, and $\tilde{T}_x$ converges to correspond to signal component $T_x$ of Figure A., i.e. to correspond to the speech component of the signal picked up by microphone 101. The result of the adaptation is that the filtering applied to the noise estimate input signal $\tilde{N}_y$ corresponds to the ratio of the acoustic transfer functions $FN_x/FN_y$.

It will be noted that, for clarity, FIG. 2 shows the noise estimate signal $\tilde{N}_y$ being applied to two separate FFT blocks $\mathbf{205}_c$ and $\mathbf{211}_A$ to generate the signal $N_{ye}$(k,l) twice. In other embodiments, the noise estimate signal $\tilde{N}_y$ is applied to just one FFT block to generate a signal that is applied to the two filter blocks 205 and 211.

The adaptation control blocks in filter blocks 205 and 211 may control the adaption of the applied filter function in any convenient way, as defined by hard-wired or programmable adaptation parameters. For example, the adaptation control blocks may control the adaption of the filters 205, 211 according to the normalised least mean squares (NLMS) method, where each coefficient hT(k,l) or hN(k,l) is updated in each frame according to the magnitude of the corresponding frequency bin signal component of the error signal $N_{ye}$ or $T_{xe}$, and according to a respective step size adaptation parameter or convergence factor $\mu_T$(k,l) or $\mu_N$(k,l):

$$hT(k,l+1)=hT(k,l)+\mu_T(k,l).N_{ye}(k,l).X^*/\|X\|^2$$

$$hN(k,l+1)=hN(k,l)+\mu_N(k,l).T_{xe}(k,l)N_{ye}(k,l)^*/\|N_{ye}(k,l)\|^2$$

where (.)* denotes as complex conjugate and $\|.\|^2$ represents the power calculation. A high value of convergence factor will give rapid convergence, but there is usually some advantage in reducing the bandwidth so as to make the loop over-damped and smooth out the coefficient values actually used.

Adaptation algorithms other than NLMS may be used, and these may operate with adaptation control parameters or step size adaptation control parameters which control the speed of convergence or gain of the adaptation control loop and may thus be regarded as convergence factors, even if the form of equations used is different from that above.

Thus, the first adaptive filter 204 filters the signal x to form filtered signal $\tilde{T}_y$ that attempts to represent the target signal $T_y$ as detected by the noise microphone 102. The subtractor 209 subtracts signal $\tilde{T}_y$ from the signal y comprising $T_y$ and $N_y$ generated by the noise microphone, to generate a signal $\tilde{N}_y$ that attempts to represent only the noise component $N_y$. The second adaptive filter 211 forms an output that attempts to represent the noise $N_x$ detected by the voice microphone. The subtractor 213 subtracts the output $\tilde{N}_x$ of the second adaptive filter from the input signal x to generate a signal $\tilde{T}_x$ which is intended to be more closely representative of the target signal as received by the voice microphone 101.

The signals X(k,l) and Y(k,l), generated from the input signals x(t) and y(t) by an input signal transform block 202, typically an FFT block, are also input into the control block 207. The control block 207 calculates the magnitude coherence between the signals X(k,l) and Y(k,l) and uses it to generate control signals α(k,l) and β(k,l), comprising adaptation parameters, which are provided to the first and second adaptive filters 205 and 211 respectively. It will be noted that FIG. 2 shows the signal X(k,l) being generated from the input signals x(t) by the input signal transform block 202, which in this case is an FFT block. Thus, the signal X(k,l) generated by the input signal transform block 202 is the same as the signal X(k,l) generated by the FFT block 205A. In other embodiments, a single FFT block may be used to generate the one signal X(k,l) that is applied to the filter 205 and to the control block 207.

As noted above, there will typically be a low magnitude coherence between the signals X(k,l) and Y(k,l) when there is no target signal present (for example, when the user of the device is not speaking), and a high magnitude coherence between the signals X(k,l) and Y(k,l) when the target signal is present (for example, when the user of the device is speaking).

Thus a first adaptive filter 204 is provided for receiving the first input signal and generating a filtered version $\tilde{T}_y$ thereof. An error calculation block 209 calculates the error between the second input signal and the filtered signal $\tilde{T}_y$ of the first adaptive filter, and outputs an error signal $\tilde{N}_y$. A second adaptive filter 210 is provided for receiving the error signal, wherein adaptation parameters of the first and second adaptive filters are controlled based on a magnitude coherence between the first and second input signals.

In particular, the control signals α(k,l) and β(k,l) may control the adaption convergence factors $\mu_T(k,l)$ or $\mu_N(k,l)$ of the first and second adaptive filters respectively. The adaption convergence factor for each adaptive filter may be generated for each frequency bin, or for several frequency bands, and for each time interval of the signals X(k,l) and Y(k,l). The magnitudes of the adaption convergence factors of the first and second adaptive filters determine in each case how quickly the respective filter can converge to the desired value. In some embodiments the control signals may convey other control information or adaptation parameters in addition to or instead of LMS convergence factor, for instance to specify an alternative adaptation algorithm or to disable the filter or reset the coefficients to some default as a fault or overload recovery mode.

In some embodiments, as shown in FIG. 2, the first adaptive filter is a noise estimation adaptive filter, while the second adaptive filter is a noise cancellation adaptive filter.

In such a case, if the user is not speaking it is beneficial for the first filter to adapt only slowly, or not at all, since there is little relevant information on which it can base any adaptation of its coefficients, whereas the second adaptive filter may be adapted more quickly to take advantage of any short gaps in the speech to improve the accuracy of the noise cancellation, in the absence of any possible spurious response due to residual interference from the voice.

Conversely, if the user is speaking it is beneficial for the first adaptive filter to be adapted more quickly to rapidly acquire a filter response that accurately removes speech components from the noise estimate signal. It is beneficial for the second adaptive filter to adapt only slowly or not at all, to avoid possible mis-adaptation due to interference from the residual voice signal or from artefacts due to the adaptation of the first filter.

The convergence factors for the first and second adaptive filters may be generated such that, when the convergence factor in one adaptive filter is a maximum convergence factor, the convergence factor in the other adaptive filter is a minimum convergence factor. For example, if the user is speaking, or a target signal is present, the convergence factor for the noise estimation adaptive filter, i.e the first adaptive filter, is set to be high, and the convergence factor for the noise cancellation adaptive filter, i.e. the second adaptive filter, is set to be low.

Similarly, if the user is not speaking, or there is no target signal, the convergence factor for the noise estimation adaptive filter, i.e the first adaptive filter, is set to be low, and the convergence factor for the noise cancellation adaptive filter, i.e. the second adaptive filter, is set to be high.

Figure 3:
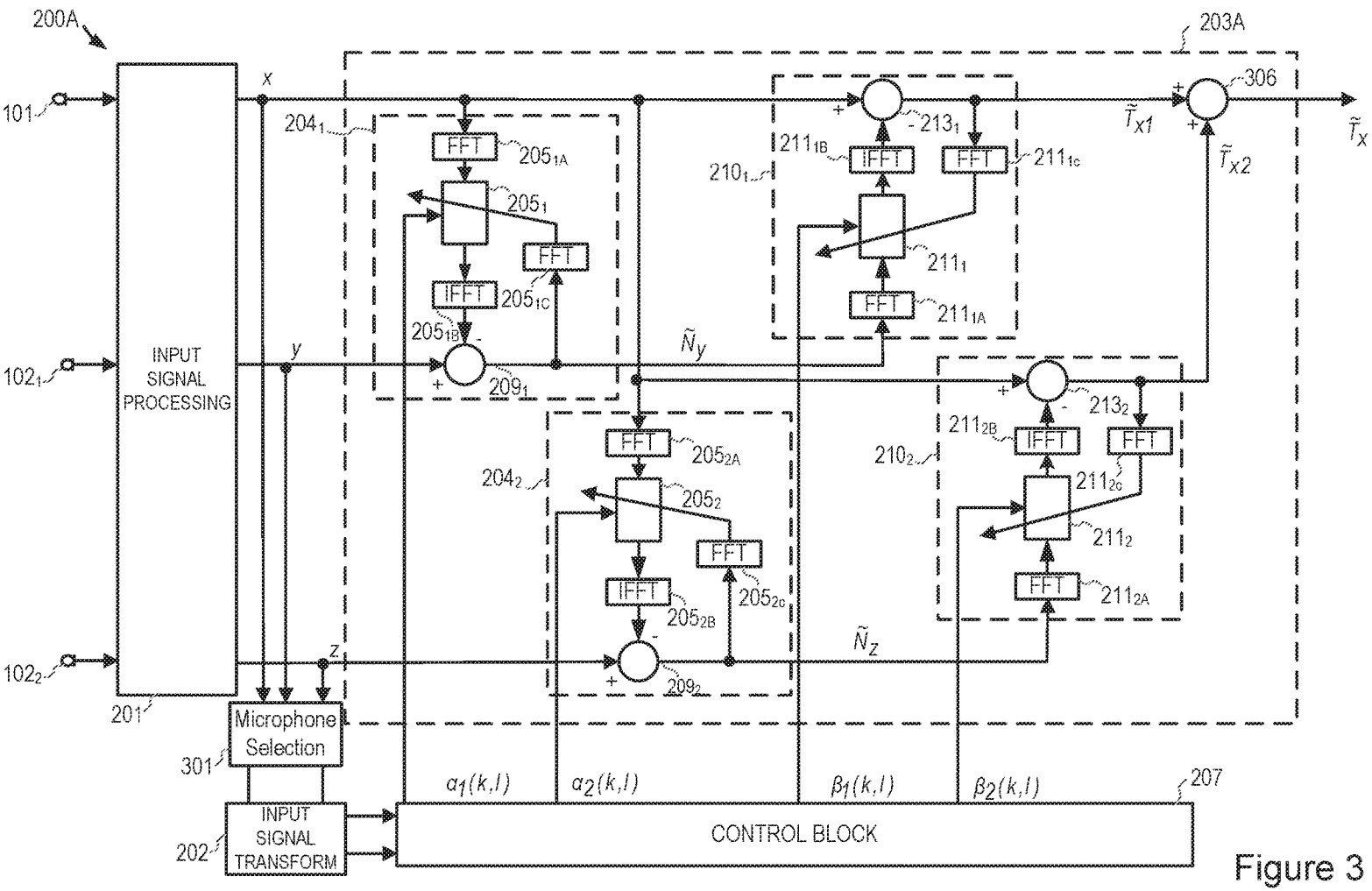
FIG. 3 illustrates processing circuitry according to another embodiment of the invention.

FIG. 3 illustrates a sound processing device generally indicated 200A according to an embodiment of the invention.

The features in this figure which are similar to those in FIGS. 1 and 2 have been given the same reference numerals, albeit with suffices 1 or 2 to differentiate repeated elements. This device utilises three input microphones. There is a first microphone 101, which may be located closest to the source of the target signal (such as a user's voice) in normal operation of the device, and two second microphones $\mathbf{102}_1$ and $\mathbf{102}_2$, which may act as noise microphones. The respective processed time domain signals x(t), y(t) and z(t), are input into a microphone selection block 301.

The sound processing circuit 203A in this embodiment includes two filters that operate similarly to the circuit 203 shown in FIG. 2. Thus, the signals x(t) and y(t) are inputs to a filter that includes the filter blocks $\mathbf{204}_1$ and $\mathbf{210}_1$, while the signals x(t) and z(t) are inputs to a filter that includes the filter blocks $\mathbf{204}_2$ and $\mathbf{210}_2$. These two filters generate respective estimates $\tilde{T}_{x1}$ and $\tilde{T}_{x2}$ of the target, or voice, signal. In this illustrated embodiment, the estimates $\tilde{T}_{x1}$ and $\tilde{T}_{x2}$ are summed to form an output estimate $\tilde{T}_x$.

The microphone selection block 301 selects the better of the two noise microphones $\mathbf{102}_1$ and $\mathbf{102}_2$ for use in calculating the operative value of the magnitude coherence. For example, the magnitude coherence may be calculated for the pair of signals x(t) and y(t), and for the pair of signals x(t) and z(t), with a decision then being made to select the pair with the maximum coherence when voice is provisionally detected, or the pair with the minimum coherence when an absence of voice is provisionally detected. The remaining noise microphone signal is effectively discounted. Hence, if the microphone $\mathbf{102}_1$ is selected, then the adaptive filters $\mathbf{205}_1$ and $\mathbf{211}_1$ are supplied with the signals $\alpha_1(k,l)$ and $\beta_1(k,l)$. The adaptive filters $\mathbf{205}_2$ and $\mathbf{211}_2$ are deactivated or set to attenuate their output signals to zero, possibly as communicated via other control bits associated with bits of $\alpha_2(k,l)$ and/or $\beta_2(k,l)$.

Alternatively, if the microphone $\mathbf{102}_2$ is selected, then the adaptive filters $\mathbf{205}_2$ and $\mathbf{211}_2$ are supplied with the signals $\alpha_2(k,l)$ and $\beta_2(k,l)$. The adaptive filters $\mathbf{205}_1$ and $\mathbf{211}_1$ are then deactivated or set to attenuate their output signals to zero possibly communicated via other control bits associated with other bits of $\alpha_1(k,l)$ and $\beta_1(k,l)$.

Therefore the signals received at the summing block 306, are a noise reduced voice signal $\tilde{T}_{x1}$ derived by adaptive filter $\mathbf{210}_1$ using a noise estimate signal $\tilde{N}_y$ derived from microphone $\mathbf{102}_1$ and zero signal from adaptive filter $\mathbf{210}_2$ or a noise reduced voice signal $\tilde{T}_{x2}$ derived by adaptive filter 210$_2$ using a noise estimate signal $\tilde{N}_z$ derived from microphone 102$_2$ and zero signal from adaptive filter 210$_1$ In this illustrated, the output estimate $T_x$ is the better of the estimates $\tilde{T}_{x1}$ and $\tilde{T}_{x2}$. In some embodiments block 306 may be simply a signal selector or multiplexer, forwarding only the desired adaptive filter output.

In other embodiments, in which the device includes more than two microphones, steps may be taken to select one pair of the microphones, with the signals from those two microphones being supplied to the inputs of a sound processing device such as the sound processing device 200 shown in FIG. 2. For example, in the case of a handset, having three microphones, positioned on the front of the handset at the bottom, on the front of the handset at the top, and on the back of the handset, the signals from the top and bottom microphones can be used for the magnitude coherence calculation, and the back microphone can be used for single channel based noise detection. In other embodiments, the signals generated by the microphones themselves can be used in determining which signals should be used for the magnitude coherence calculation.

Figure 4:
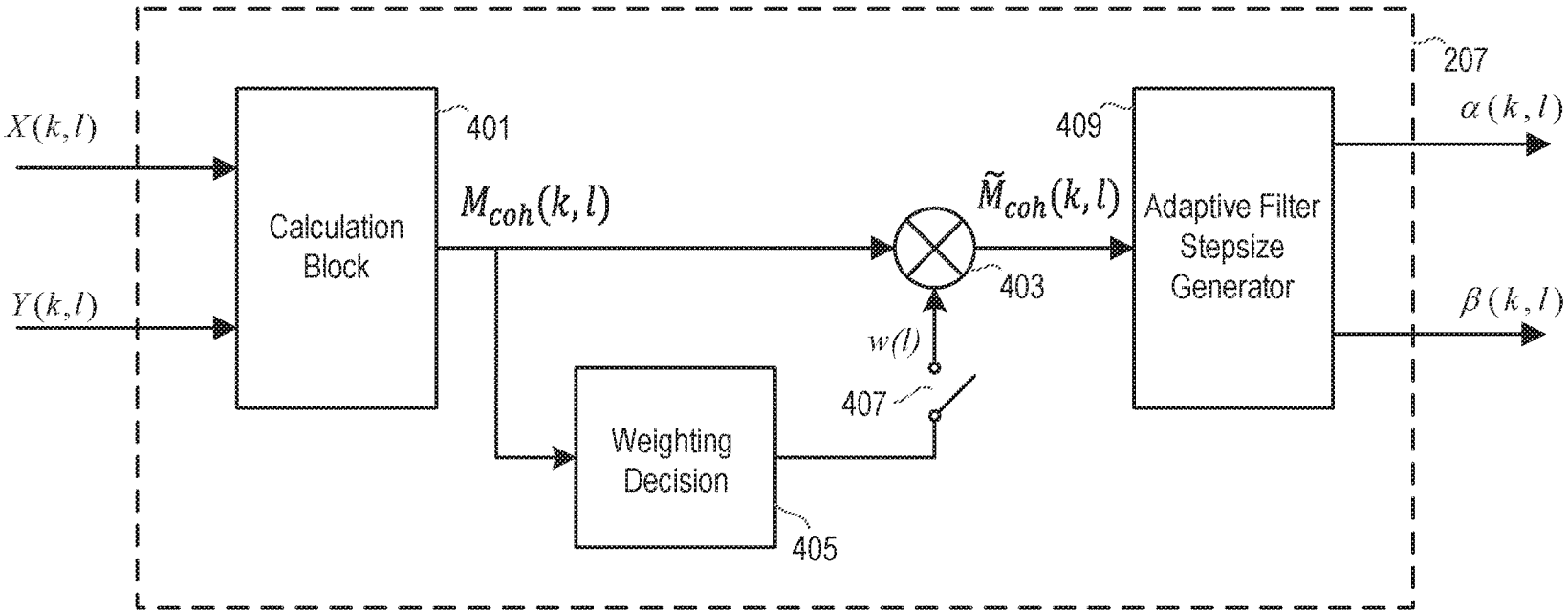
FIG. 4 illustrates a more detailed version of the control block in the processing circuitry of FIG. 2 or FIG. 3.

FIG. 4 illustrates a more detailed version of the control block 207.

A calculation block 401 receives the signals X(k,l) and Y(k,l) and calculates the magnitude coherence between the two signals.

Figure 5:
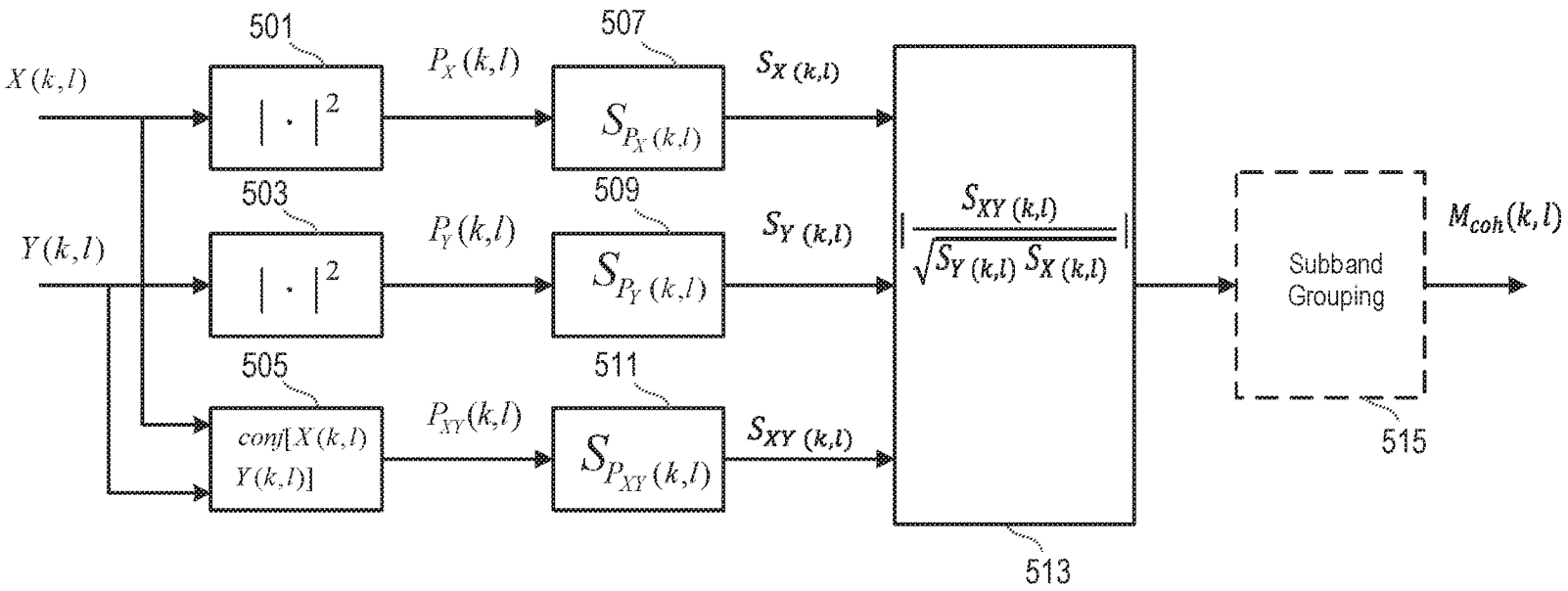
FIG. 5 illustrates a more detailed version of the calculation block in the control block of FIG. 4.

FIG. 5 illustrates a more detailed version of the calculation block 401.

Magnitude coherence, $M_{coh}(k,l)$ can be calculated in the frequency domain using the equation:

$$M_{coh}(k,l)=\left|\frac{S_{XY}(k,l)}{\sqrt{S_Y(k,l)S_X(k,l)}}\right|,$$

where $S_X(k,l)$, $S_Y(k,l)$ and $S_{XY}(k,l)$ are smoothed signals calculated from the signals X(k,l) and Y(k,l).

Therefore, the calculation block 401 in FIG. 5 comprises a first power block 501 for receiving the signal X(k,l) and outputting the square of the magnitude of this signal, i.e. a signal representing its power $P_X(k,l)$. A second power block 503 receives the signal Y(k,l) and similarly outputs the square of its magnitude, i.e. a signal representing its power $P_Y(k,l)$.

Both signals X(k,l) and Y(k,l) are input into a cross conjugation block 505 which outputs the cross conjugation of the two signals, which is referred to as $P_{XY}(k,l)$.

The signals $P_X(k,l)$, $P_Y(k,l)$ and $P_{XY}(k,l)$ are input into smoothing blocks 507, 509, and 511 respectively. These blocks perform time smoothing on their respective input signals in order to reduce the fluctuations of the instantaneous signals. The smoothing blocks 507, 509 and 511 output the signals $S_X(k,l)$, $S_Y(k,l)$ and $S_{XY}(k,l)$ respectively.

For example, the smoothed signals $S_X(k,l)$, $S_Y(k,l)$ and $S_{XY}(k,l)$ may be calculated as:

$$S_X(k,l)=\delta S_X(k,l-1)+(1-\delta)P_X(k,l)$$

$$S_Y(k,l)=\delta S_Y(k,l-1)+(1-\delta)P_Y(k,l)$$

$$S_{XY}(k,l)=\delta S(k,l-1)+(1-\delta)P_{XY}(k,l),$$

where $0<\delta<1$.

It will be appreciated that the magnitude coherence may be calculated without this time smoothing step.

The smoothed signals $S_X(k,l)$, $S_Y(k,l)$ and $S_{XY}(k,l)$ are input into a final calculation block 413 which uses the signals to calculate:

$$\left|\frac{S_{XY}(k,l)}{\sqrt{S_Y(k,l)S_X(k,l)}}\right|,$$

and output this as the magnitude coherence $M_{coh}(k,l)$.

In some embodiments there may also be a sub-band grouping block 515, which groups the calculation of the magnitude coherence across a number of frequency bins, hence grouping the frequency bins into sub-bands. For example, larger sub-bands may be used for frequencies outside the frequency range of normal speech for applications where speech is the target signal, as these frequencies are unlikely to ever contain any target signal, and so the requirement for accurate processing is reduced.

Returning to FIG. 4, the magnitude coherence $M_{coh}(k,l)$, which may be calculated as shown in FIG. 5, is input into a multiplication block 403. A weighting decision block 405 also receives the magnitude coherence $M_{coh}(k,l)$ and determines whether or not to apply a weighting factor w(l) to the magnitude coherence.

A weighted magnitude coherence is useful when it becomes difficult to differentiate between speech and noise at low frequency bands. This is because the microphone separation on some devices is not large enough to provide sufficient differentiation. As a result, the low frequency components of the target signal at the two microphones become quite well correlated with each other.

An example of how to implement a weighted magnitude coherence is to determine if the mean value of the magnitude coherence across a band of medium-to-high frequencies is below a predetermined threshold value $w_{td}$. If so, then a weighting factor is applied to the magnitude coherence by closing the switch 407 such that the previously calculated magnitude coherence is multiplied by the weighting factor w(l) by the multiplication block 403. In other words, if the magnitude coherence is low in a high frequency band, typically because a target signal is not present in the high frequency bands, then there is a high likelihood that there is no target signal present in some of the lower frequency bands, even though there is high correlation in low frequency bands. Hence the magnitude coherence is adjusted, in such a way that it is more likely to show low coherence in the lower frequency bands if there is low coherence in the higher frequency bands.

In this example implementation of a weighting factor, the following equations can be used to determine the weighted magnitude coherence $\overline{M_{coh}}(k,l)$.

$$\overline{M_{coh}}(k,l)=w(l)M_{coh}(k,l) \text{ wherein,}$$

$$w(l)=\begin{cases} w_0, & \text{if } \frac{1}{k2-k1+1}\sum_{k=k1}^{k2} M_{coh}(k,l)<w_{td}(k) \\ 1, & \text{otherwise} \end{cases}$$

In this equation, $k_1$ and $k_2$ are two frequency bins both in the medium-to-high frequency range, hence showing whether the magnitude coherence is high or low for high frequencies as described above. $w_{td}(k)$ is frequency dependent or subband dependent and is pre-defined. The value of $w_0$ can be chosen to be between 0 and 1.

The weighted magnitude coherence is input into an adaptive filter convergence factor generation block 409. It will be appreciated, however, that the raw magnitude coherence could be used instead of the weighted magnitude coherence.

The adaptive filter convergence factor generation block 409 calculates the adaption convergence factor for both the first adaptive filter 205 and the second adaptive filter 211 as shown in FIG. 2, and outputs these convergence factors as control signals $\alpha(k,l)$ and $\beta(k,l)$. The relationship between the magnitude coherence and these two convergence factors is described in more detail with reference to FIG. 6.

For applications where sub-band grouping is used, the adaptive filter convergence factor is generated for each frequency sub-band, and hence the control signals $\alpha(k,l)$ and $\beta(k,l)$ will contain instructions for each frequency sub-band rather than each frequency bin.

Figure 6:
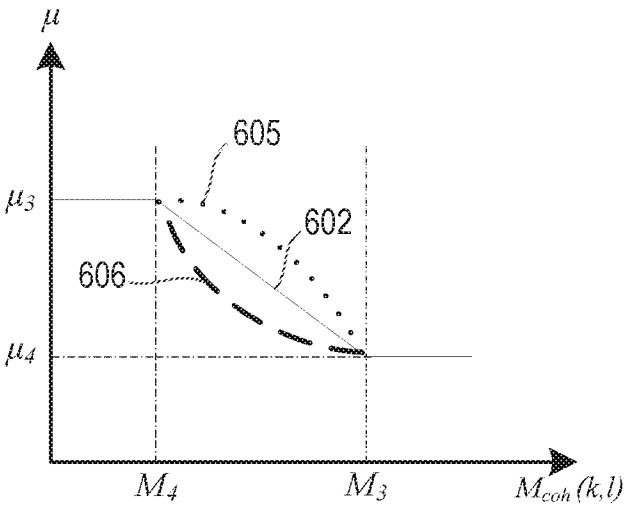
FIG. 6 illustrates two graphs of the convergence factor as a function of the magnitude coherence for a noise estimation filter and a noise cancellation adaptive filter.
Figure 6:
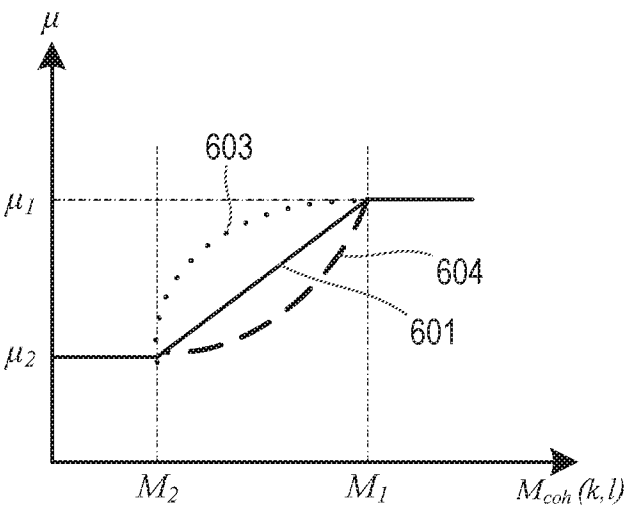

FIG. 6 contains graphs representing examples of the control signals or adaptation parameters generated according to embodiments of the invention.

Specifically, FIG. 6 contains examples of how the adaptive filter convergence factor generation block 409 may determine the convergence factor for each adaptive filter based on the (weighted) magnitude coherence.

FIG. 6, view (a) shows the relationship between the weighted magnitude coherence and the convergence factor $\mu$ for a noise estimation adaptive filter, for example the first adaptive filter 205 shown in FIG. 2.

FIG. 6, view (b) shows the relationship between the weighted magnitude coherence and the convergence factor $\mu$ for a noise cancellation adaptive filter, for example, the second adaptive filter 210 shown in FIG. 2.

As previously discussed, if the magnitude coherence is large, the convergence factor for a noise estimation adaptive filter is preferably set to be large and the convergence factor for a noise cancellation adaptive filter is preferably set to be small. By contrast, if the magnitude coherence is small, the convergence factor for a noise estimation adaptive filter is preferably set to be small and the convergence factor for a noise cancellation adaptive filter is preferably set to be large.

In some embodiments, if the magnitude coherence is large, i.e. towards the right hand side of the horizontal axes in FIG. 6, view (a) and FIG. 6, view (b), the first adaptive filter is controlled to have a maximum convergence factor $\mu_1$, as shown in FIG. 6, view (a), and the second adaptive filter is controlled to have a minimum convergence factor $\mu_4$ as shown in FIG. 6, view (b).

Conversely, if the magnitude coherence is small i.e. towards the left hand side of the horizontal axes in FIG. 6, view (a) and FIG. 6, view (b), the first adaptive filter is controlled to have a minimum convergence factor $\mu$2 as shown in FIG. 6, view (a), and the second adaptive filter is controlled to have a maximum convergence factor $\mu_3$ as shown in FIG. 6, view (b).

In particular, in FIG. 6, view (a) if the magnitude coherence is above a first threshold value $M_1$, for a particular frequency bin and time interval, the first adaptive filter 205 is controlled to have the maximum convergence factor $\mu_1$ for that frequency bin and time interval. If the magnitude coherence is below a second threshold value $M_2$ for a particular frequency bin and time interval, the first adaptive filter 205 is controlled to have a minimum convergence factor $\mu_2$ for that frequency bin and time interval.

In some embodiments the threshold values $M_1$ and $M_2$ may be equal. In other embodiments the value of $M_1$ is greater than the value of $M_2$.

In FIG. 6, view (b), if the magnitude coherence is above a third threshold value $M_3$ for a particular frequency bin and time interval, the second adaptive filter 211 is controlled to have a minimum convergence factor $\mu_4$ for that frequency bin and time interval. If the magnitude coherence is below a fourth threshold value $M_4$ for a particular frequency bin and time interval, the second adaptive filter 211 is controlled to have a maximum convergence factor $\mu_3$ for that frequency bin and time interval.

The third threshold value $M_3$ may be the same as the fourth threshold value $M_4$. Alternatively, the third threshold value $M_3$ may be greater than the fourth threshold value $M_4$.

The respective upper threshold values for the first and second adaptive filters, that is the first and third threshold values $M_1$ and $M_3$, may be the same or different. Similarly, the respective lower threshold values for the first and second adaptive filters, that is the second and fourth threshold values $M_2$ and $M_4$, may be the same or different.

In both FIG. 6, view (a) and FIG. 6, view (b), if the magnitude coherence value is between the respective upper ($M_1$ or $M_3$) and lower ($M_2$ or $M_4$) threshold values for a particular frequency bin and time interval the adaptive filter convergence factor, for either the first or second adaptive filter, may controlled by generating the convergence factor using a linear relationship, as shown by the solid lines 601 and 602 in FIG. 6, view (a) and FIG. 6, view (b), respectively.

Alternatively, if the magnitude coherence is between the upper and lower threshold values (that is, between $M_1$ and $M_2$ or between $M_3$ and $M_4$) for a particular frequency bin and time interval, the adaptive filter convergence factor, for either the first or second adaptive filter, may be controlled by generating the convergence factor using a non-linear relationship, for example a polynomial curve such as one of the curves shown by the dotted lines 603 or 604 shown in FIG. 6, view (a) or the dotted lines 605 or 606 shown in FIG. 6, view (b). Different polynomial curves can be used to control the aggressiveness of the convergence factor generation.

The rate of convergence factor change can also be easily controlled by altering the differences between the thresholds $M_1$ and $M_2$ or $M_3$ and $M_4$. The closer together the value of the thresholds, the faster the convergence factor change will occur.

Figure 7:
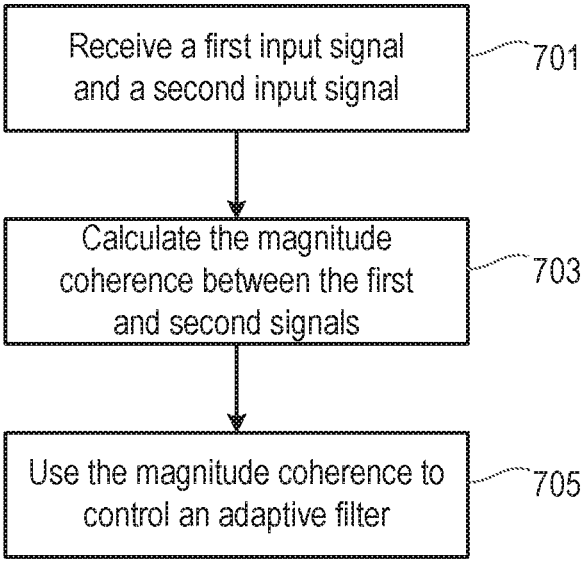
FIG. 7 is a flow chart of a method according to embodiments of the invention.

FIG. 7 is a flow chart illustrating a method according to embodiments of the invention.

In step 701 a sound processing circuit receives a first input signal and a second input signal. The first and second input signals may be in the frequency domain.

In step 703 the sound processing circuit calculates the magnitude coherence between the first and second signals.

In step 705 the sound processing circuit uses the magnitude coherence to control the adaptive filter.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware Embodiments of the invention may be arranged as part of an audio processing circuit, for instance an audio circuit which may be provided in a host device. A circuit according to an embodiment of the present invention may be implemented as an integrated circuit. One or more loudspeakers may be connected to the integrated circuit in use.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in detachable speakerphone accessories or external microphone arrays or the like. The host device may comprise memory for storage of code to implement methods embodying the invention. This code may be stored in the memory of the device during manufacture or test or be loaded into the memory at a later time.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

There is therefore provided a sound processing circuitry for receiving two input signals in the frequency domain and calculating the magnitude coherence between them for use in controlling the convergence factor or other adaptation parameters of adaptive filters which are used in the processing of the two input signals.

The invention claimed is:

1. A sound processing circuit comprising:

a first input for receiving a first input signal, a second input for receiving a second input signal, a first adaptive filter for receiving the first input signal, an error calculation block for calculating an error between the second input signal and the output of the first adaptive filter, and outputting an error signal, a second adaptive filter for receiving the error signal, an output calculation block for subtracting an output of the second adaptive filter from the first input signal to generate an output signal, wherein the adaptation of first and second adaptive filters is controlled based on a magnitude coherence between the first and second input signals.

2. A sound processing circuit as claimed in claim 1, wherein respective convergence factors of the first and second adaptive filters are controlled based on the magnitude coherence.

3. A sound processing circuit as claimed in claim 2, wherein the convergence factors of the first and second adaptive filters are generated such that, when the convergence factor in one adaptive filter is a maximum convergence factor, the convergence factor in the other adaptive filter is a minimum convergence factor.

4. A sound processing circuit as claimed in claim 1, wherein the first input signal is assumed to contain primarily a target signal and the second input signal is assumed to contain primarily ambient noise, such that the first adaptive filter is a noise estimation adaptive filter.

5. A sound processing circuit as claimed in claim 4, wherein the second adaptive filter is a noise cancellation adaptive filter.

6. A sound processing circuit as claimed in claim 3, wherein, if the magnitude coherence between the first and second input signals is greater than an upper threshold value, the first adaptive filter is controlled to have a maximum convergence factor, and the second adaptive filter is controlled to have a minimum convergence factor.

7. A sound processing circuit as claimed in claim 3, wherein if the magnitude coherence between the first and second input signals is lower than a lower threshold value, the first adaptive filter is controlled to have a minimum convergence factor, and the second adaptive filter is controlled to have a maximum convergence factor.

8. A sound processing circuit as claimed in claim 2, wherein, if the magnitude coherence is above a first threshold value for a particular frequency bin and time frame, the first adaptive filter is controlled to have a maximum convergence factor for that frequency bin and time frame, or if the magnitude coherence is below a second threshold value for a particular frequency bin and time frame, the first adaptive filter is controlled to have a minimum convergence factor for that frequency bin and time frame.

9. A sound processing circuit as claimed in claim 8, wherein the first threshold value is the same as the second threshold value.

10. A sound processing circuit as claimed in claim 8, wherein the first threshold value is an upper threshold value and the second threshold value is a lower threshold value, and the upper threshold value is larger than the lower threshold value.

11. A sound processing circuit as claimed in claim 10 wherein, if the magnitude coherence is between the upper and lower threshold values for a particular frequency bin and time frame, the adaptive filter convergence factor is controlled by generating the convergence factor using a linear relationship.

12. A sound processing circuit as claimed in claim 10 wherein, if the magnitude coherence is between the upper and lower threshold values for a particular frequency bin and time frame, the adaptive filter convergence factor is controlled by generating the convergence factor using a polynomial curve.

13. A sound processing circuit as claimed in claim 2, wherein, if the magnitude coherence is above a third threshold value for a particular frequency bin and time frame, the second adaptive filter is controlled to have a minimum convergence factor for that frequency bin and time frame, or if the magnitude coherence is below a fourth threshold value for a particular frequency bin and time frame, the second adaptive filter is controlled to have a maximum convergence factor for that frequency bin and time frame.

14. A sound processing circuit as claimed in claim 13 wherein the third threshold value is the same as the fourth threshold value.

15. A sound processing circuit as claimed in claim 13, wherein the third threshold value is an upper threshold value and the fourth threshold value is a lower threshold value, and the upper threshold value is larger than the lower threshold value.

16. A sound processing circuit as claimed in claim 15 wherein, if the magnitude coherence is between the upper and lower threshold values for a particular frequency bin and time frame, the adaptive filter convergence factor is controlled by generating the convergence factor using a linear relationship.

17. A sound processing circuit as claimed in claim 15 wherein, if the magnitude coherence is between the upper and lower threshold values for a particular frequency bin and time frame, the adaptive filter convergence factor is controlled by generating the convergence factor using a polynomial curve.

18. A sound processing circuit as claimed in claim 3, wherein the first and second input signals comprise values in a plurality of frequency bins, and wherein the frequency bins are grouped into frequency sub-bands and the adaptive filter convergence factor is generated for each frequency sub-band.

19. A sound processing circuit as claimed in claim 1, wherein the magnitude coherence is a weighted magnitude coherence $\overline{M_{coh}}(k, l)$ and the weighted coherence is calculated as follows:

$$\overline{M_{coh}}(k, l) = w(l)M_{coh}(k, l) \text{ wherein,}$$

$$w(l) = \begin{cases} w_0, & \text{if } \frac{1}{k2-k1+1}\sum_{k=k1}^{k2} M_{coh}(k, l) < w_{td}(k) \\ 1, & \text{otherwise} \end{cases}$$

20. A portable device comprising:

a first microphone to provide a first input signal, a second microphone to provide a second input signal, and a sound processing circuit, wherein the sound processing circuit comprises:

a first adaptive filter for receiving the first input signal, an error calculation block for calculating an error between the second input signal and the output of the first adaptive filter, and outputting an error signal, a second adaptive filter for receiving the error signal, an output calculation block for subtracting an output of the second adaptive filter from the first input signal to generate an output signal, wherein the adaptation of first and second adaptive filters is controlled based on a magnitude coherence between the first and second input signals.

21. A portable device as claimed in claim 20, wherein the microphones are between 5 cm and 25 cm apart.

22. A portable device as claimed in claim 20, wherein the device is a communication device.

23. A method of processing a sound signal, the method comprising:

receiving a first input signal and a second input signal, wherein the first and second input signals are in the frequency domain, applying the first input signal to a first adaptive filter, calculating an error between the second input signal and an output of the first adaptive filter, and outputting an error signal, applying the error signal to a second adaptive filter, subtracting an output of the second adaptive filter from the first input signal to form an output signal, calculating the magnitude coherence between the first and second signals, and controlling adaptation parameters of the first adaptive filter and the second adaptive filter based on the magnitude coherence.

24. A computer program product, comprising a non-transitory computer readable medium, having stored thereon computer readable code, for causing a processing device to perform a method comprising:

receiving a first input signal and a second input signal, wherein the first and second input signals are in the frequency domain, applying the first input signal to a first adaptive filter, calculating an error between the second input signal and an output of the first adaptive filter, and outputting an error signal, applying the error signal to a second adaptive filter, subtracting an output of the second adaptive filter from the first input signal to form an output signal, calculating the magnitude coherence between the first and second signals, and controlling adaptation parameters of the first adaptive filter and the second adaptive filter based on the magnitude coherence.

* * * * *